US006604016B1

(12) United States Patent
Andersson

(10) Patent No.: US 6,604,016 B1
(45) Date of Patent: Aug. 5, 2003

(54) IRON CASTINGS WITH COMPACTED OR SPHEROIDAL GRAPHITE PRODUCED BY DETERMINING COEFFICIENTS FROM COOLING CURVES AND ADJUSTING THE CONTENT OF STRUCTURE MODIFYING AGENTS IN THE MELT

(75) Inventor: Conny Andersson, Eskilstuna (SE)

(73) Assignee: SinterCast AB, Stockholm (SE)

( * ) Notice: Subject to any disclaimer, the term of this patent is extended or adjusted under 35 U.S.C. 154(b) by 0 days.

(21) Appl. No.: 09/530,546

(22) PCT Filed: Nov. 17, 1998

(86) PCT No.: PCT/SE98/02072

§ 371 (c)(1),
(2), (4) Date: May 2, 2000

(87) PCT Pub. No.: WO99/25888

PCT Pub. Date: May 27, 1999

(30) Foreign Application Priority Data

Nov. 17, 1997 (SE) ..... 9704208

(51) Int. Cl.[7] ..... C22C 33/08; G06F 19/00
(52) U.S. Cl. ..... 700/204; 164/4.1; 75/382
(58) Field of Search ..... 700/197, 202, 700/204; 164/4.1, 154.1; 75/382

(56) References Cited

U.S. PATENT DOCUMENTS 4,667,725 A * 5/1987 Backerud ..... 164/4.1
5,337,799 A * 8/1994 Backerud ..... 164/4.1
6,102,981 A * 8/2000 Lindholm ..... 75/382

FOREIGN PATENT DOCUMENTS

| | | |
|---|---|---|
| WO | 86/01755 | 3/1986 |
| WO | WO91/13176 | 9/1991 |
| WO | WO92/06809 | 4/1992 |
| WO | WO96/23206 | 8/1996 |

* cited by examiner

*Primary Examiner*—Leo Picard
*Assistant Examiner*—Sheela Rao
(74) *Attorney, Agent, or Firm*—Pillsbury Winthrop LLP

(57) ABSTRACT

A sampling device for thermal analysis of solidifying metal, comprising at least one container intended to contain a sample quantity (30) of liquid metal during analysis, and at least one sensor (40, 220, 240) for thermal analysis, said sensor(s) being intended to be at least partly immersed in the solidifying metal sample quantity during analysis. The container comprises an inner wall (50), with an interior surface (60) intended to face the sample quantity during analysis, and an exterior surface (70); an outer wall (80), with an exterior surface (100) intended to face the ambient atmosphere, and an interior surface (90); said walls being joined at the mouth of the container whereby the exterior surface (70) of the inner wall (50) and the interior surface (90) of the outer wall (80) together define an essentially closed space (110).

12 Claims, 5 Drawing Sheets

Figure 1:
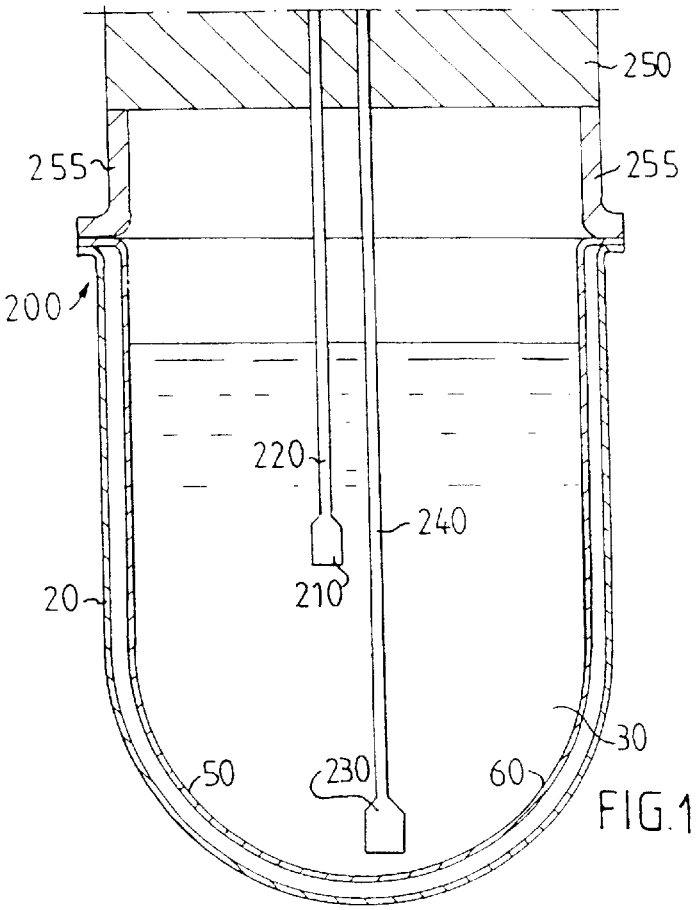

IRON CASTINGS WITH COMPACTED OR SPHEROIDAL GRAPHITE PRODUCED BY DETERMINING COEFFICIENTS FROM COOLING CURVES AND ADJUSTING THE CONTENT OF STRUCTURE MODIFYING AGENTS IN THE MELT

This application is the national phase of international application PCT/SE98/02072 filed Nov. 17, 1998 which designated the U.S.

The present invention relates to an improved method for predicting the microstructure with which a certain cast iron melt will solidify. The invention also relates to an apparatus for carrying out the method.

BACKGROUND OF THE INVENTION

WO86/01755 (incorporated by reference) discloses a method for producing compacted graphite cast iron by using thermal analysis. A sample is taken from a bath of molten cast iron and this sample is permitted to solidify during 0.5 to 10 minutes. The temperature is recorded simultaneously by two temperature responsive means, one of which is placed in the centre of the sample and the other in the immediate vicinity of the vessel wall. So-called cooling curves representing temperature of the iron sample as a function of time are recorded for each of the two temperature responsive means. According to this document it is then possible to determine the necessary amount of structure-modifying agents that must be added to the melt in order to obtain the desired microstructure. However, no detailed information is given about how to evaluate the curves.

WO92/06809 (incorporated by reference) describes a specific method for evaluating the cooling curves obtained by the method of WO86/01755. According to this document, an early plateau in the cooling curve indicates that flake graphite crystals have precipitated close to the temperature responsive means. As the sample vessel is intentionally coated with a layer of oxide or sulfide-bearing material which consumes the active form of the structure-modifying agents, and thus simulates its natural loss or fading during the casting period, such a plateau can often be found in a cooling curve from a temperature responsive means arranged close to the vessel wall. The skilled person can then determine whether any structure-modifying agent has to be added to the melt in order to obtain compacted graphite cast iron by using calibration data.

The method of WO92/06809 requires "perfect" curves comprising a distinct plateau. However, sometimes cooling curves without a distinct plateau are recorded despite the fact that flaky graphite has been formed. Up to now, it has not been possible to use curves without a distinct plateau as a basis for calculating the precise amount of structure-modifying agent that must to be added to the melt in order to produce compacted graphite cast iron over the entire casting period.

SUMMARY OF THE INVENTION

Now, it has turned out that it is possible to use virtually any set of cooling curves obtained for eutectic and under-eutectic solidification, and by the equipment of WO86/01755 and WO92/06809 as a basis for calculating the precise amount of structure-modifying agent that must be added. The method of the present invention comprises the steps of:

a) determining the amount of structure-modifying agent that has to be added to the melt in order to obtain compacted graphite cast iron, or spheroidal graphite cast iron, as a function of $\gamma$, where $$\gamma=(TA_{max}-TA_{min})/(TB_{max}-TB_{min})$$

and wherein $TA_{max}$ is the local maximum value of the cooling curve recorded at the centre of the sample vessel;

$TA_{min}$ is the local minimum value of the cooling curve recorded at the centre of the sample vessel;

$TB_{max}$ is the local maximum value of the cooling curve recorded at the sample vessel wall;

$TB_{min}$ is the local minimum value of the cooling curve recorded at the sample vessel wall;

b) determining the amount of structure-modifying agent that has to be added to the melt in order to obtain compacted graphite cast iron, or spheroidal graphite cast iron, as a function of $\phi$, where $$\phi=(TA'_{max}/(TB'_{max})$$

wherein $TA'_{max}$ is the maximum value of the first derivative of the cooling curve recorded at the centre of the sample vessel; and $TB'_{max}$ is the maximum value of the first derivative of the cooling curve recorded at the sample vessel wall;

c) determining the amount of structure-modifying agent that has to be added to the melt in order to obtain compacted graphite cast iron, or spheroidal graphite cast iron as a function of the area ($\rho_B$) of the first peak of the first derivative of the cooling curve recorded at the sample vessel wall;

d) determining the amount of structure-modifying agent that has to be added to the melt in order to obtain compacted graphite cast iron, or spheroidal graphite cast iron as a function of $\kappa$, where:

$$\kappa=\sigma_A/\sigma_B$$

wherein $\sigma_A$ is the area under the second peak of the first derivative of the cooling curve recorded in the centre of the sample vessel; and $\sigma_B$ is the area under the second peak of the first derivative of the cooling curve recorded at the vessel wall;

e) recording cooling curves at the centre of the sample vessel and at the sample vessel wall, respectively, for a particular sample of a molten cast iron;

f) depending on the result in e) choosing one of the calibration curves from step a)–d) giving the most accurate result; and g) calculating the amount of structure modifying agent that has to be added to the melt.

DETAILED DESCRIPTION OF THE INVENTION

As already mentioned, the present invention relates to an improved method for predicting the microstructure in which a certain cast iron melt will solidify. By using the present method, it is possible to evaluate a much larger range of temperature time curves compared to the state of the art and it is also possible to obtain more accurate results.

The term "cooling curve" as utilized herein refers to graphs representing the temperature as a function of time, which graphs have been recorded in the manner disclosed in WO86/01755 and WO92/06809.

The term "sample vessel" as disclosed herein, refers to a small sample container which, when used for thermal analysis, is filled with a sample of molten metal. The temperature of the molten metal is then recorded during solidification in a suitable way. The walls of the sample vessel are coated with a material which reduces the amount of structure-modifying agent in the melt in the immediate vicinity of the vessel wall. Preferably the sample vessel is designed in the manner disclosed in WO86/01755, WO92/06809, WO91/13176 (incorporated by reference) and WO96/23206 (incorporated by reference).

The term "sampling device" as disclosed herein, refers to a device comprising a sample vessel equipped with at least one temperature responsive means for thermal analysis, said means being intended to be immersed in the solidifying metal sample during analysis, and a means for filling the sample vessel with molten metal. The sample vessel is preferably equipped with said sensors in the manner disclosed in WO96/23206.

The term "structure-modifying agent" as disclosed herein, relates to compounds either promoting spheroidization or precipitation of the graphite present in the molten cast iron. Suitable compounds can be chosen from the group of inoculating substances well-known in the art, and shape-modifying agents, such as magnesium, cerium and other rare earth metals. The relationship between the concentration of structure-modifying agents in molten cast irons and the graphite morphology of solidified cast irons have already been discussed in the above cited documents WO92/06809 and WO86/01755.

The invention also relates to an apparatus for controlling the production of compacted graphite cast iron, which apparatus takes a sample of molten cast iron, uses the present method for calculating the necessary additions, if any, of structure-modifying agents to the molten cast iron, and provides the molten cast iron with said amount of structure-modifying agents. The apparatus comprises a sampling device, a computer-based data acquisition system, and a means for administrating structure-modifying agents to the molten cast ron. The sampling device contains a representative sample of the molten cast iron which is subjected to thermal analysis during which temperature/time measurements are transmitted to a computer and presented in the form of cooling curves. The computer calculates the necessary amount of structure-modifying agent that must be added and automatically actuates the means for administrating the structure-modifying agent, whereby the melt is supplied with an appropriate amount of such agents.

Figure 2:
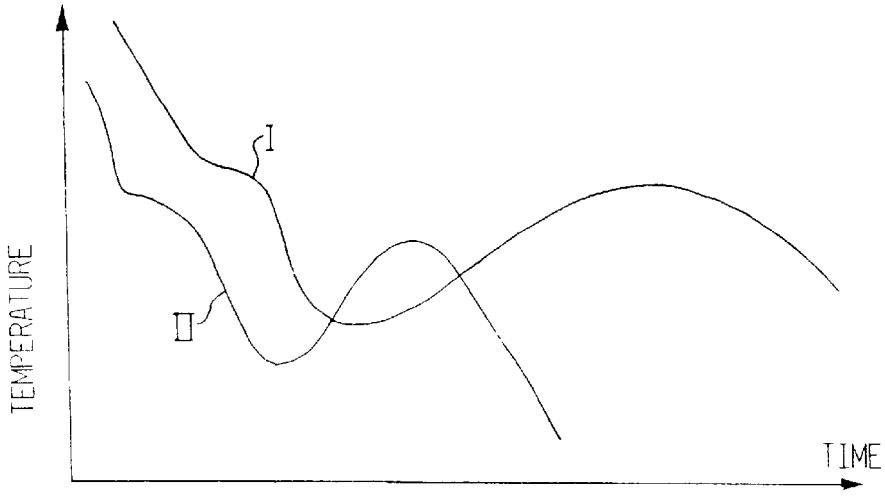
Figure 3:
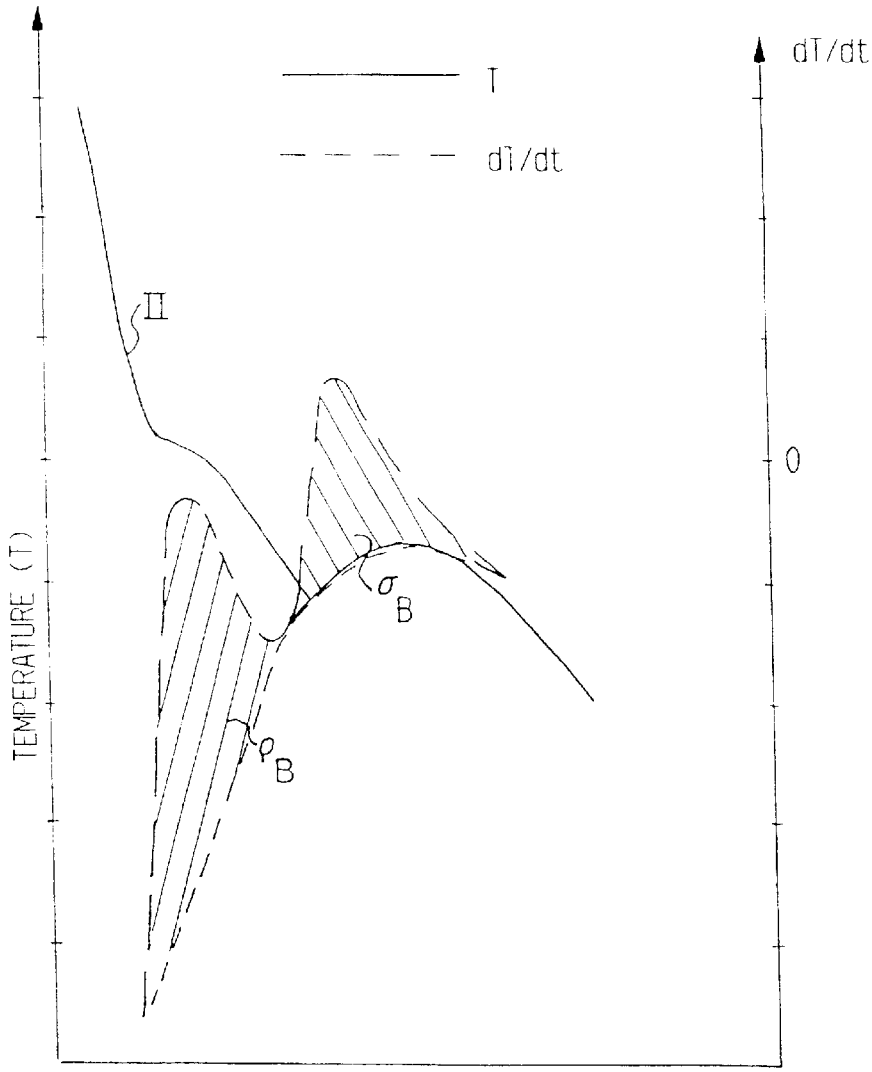
Figure 4A:
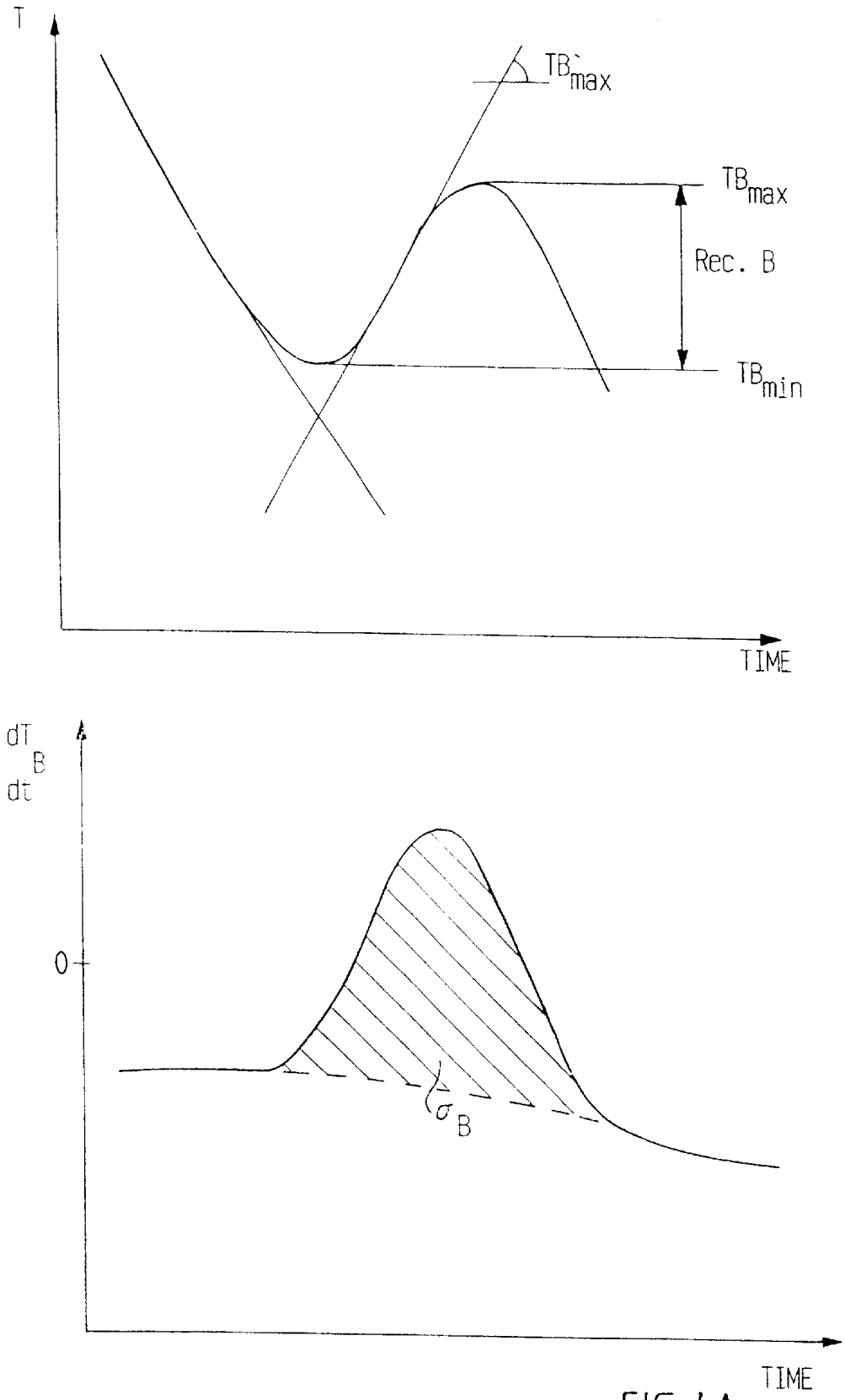

The invention will now be described with reference to the accompanying figures in which:

FIG. 1 is a cross section through a part of a sampling device that can be used in connection with the present invention;

FIG. 2 discloses examples of cooling curves recorded with two temperature responsive means, one being arranged in the middle of the sample vessel (curve I) and the other near the vessel wall (curve II);

FIG. 3 shows a cooling curve corresponding to curve II in FIG. 2. The first time derivative of the curve is also disclosed;

FIG. 4A defines the parameters $TB'_{max}$, $TB_{max}$ $TB_{min}$. The figure shows TB values and $\sigma_B$ for the part of a wall-region cooling curve comprising a wall-region conventional undercooling recalescence and steady state growth. The centre curve parameters are generally marked with a capital A whereas wall parameters are marked with a capital B.

Figure 5:
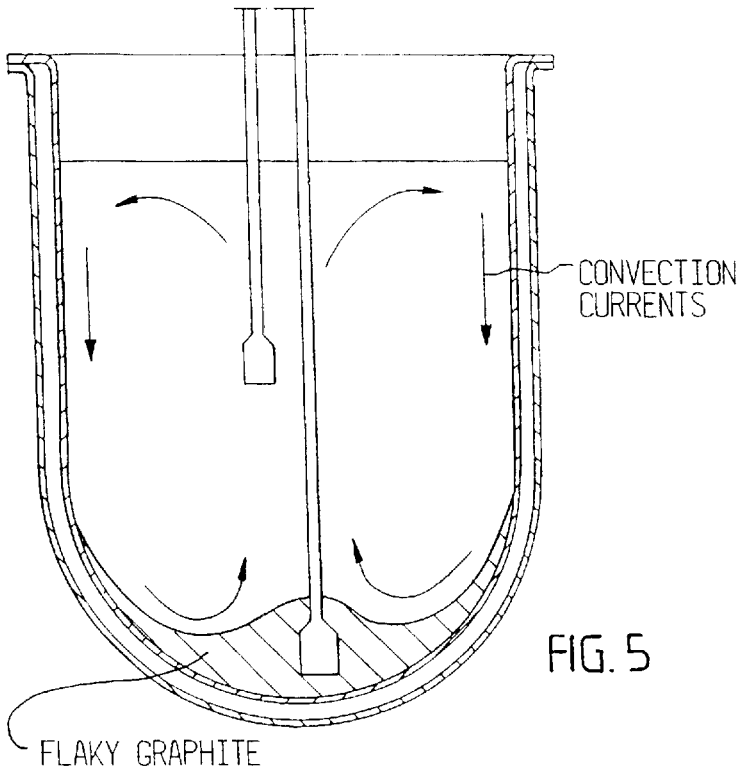
Figure 4B:
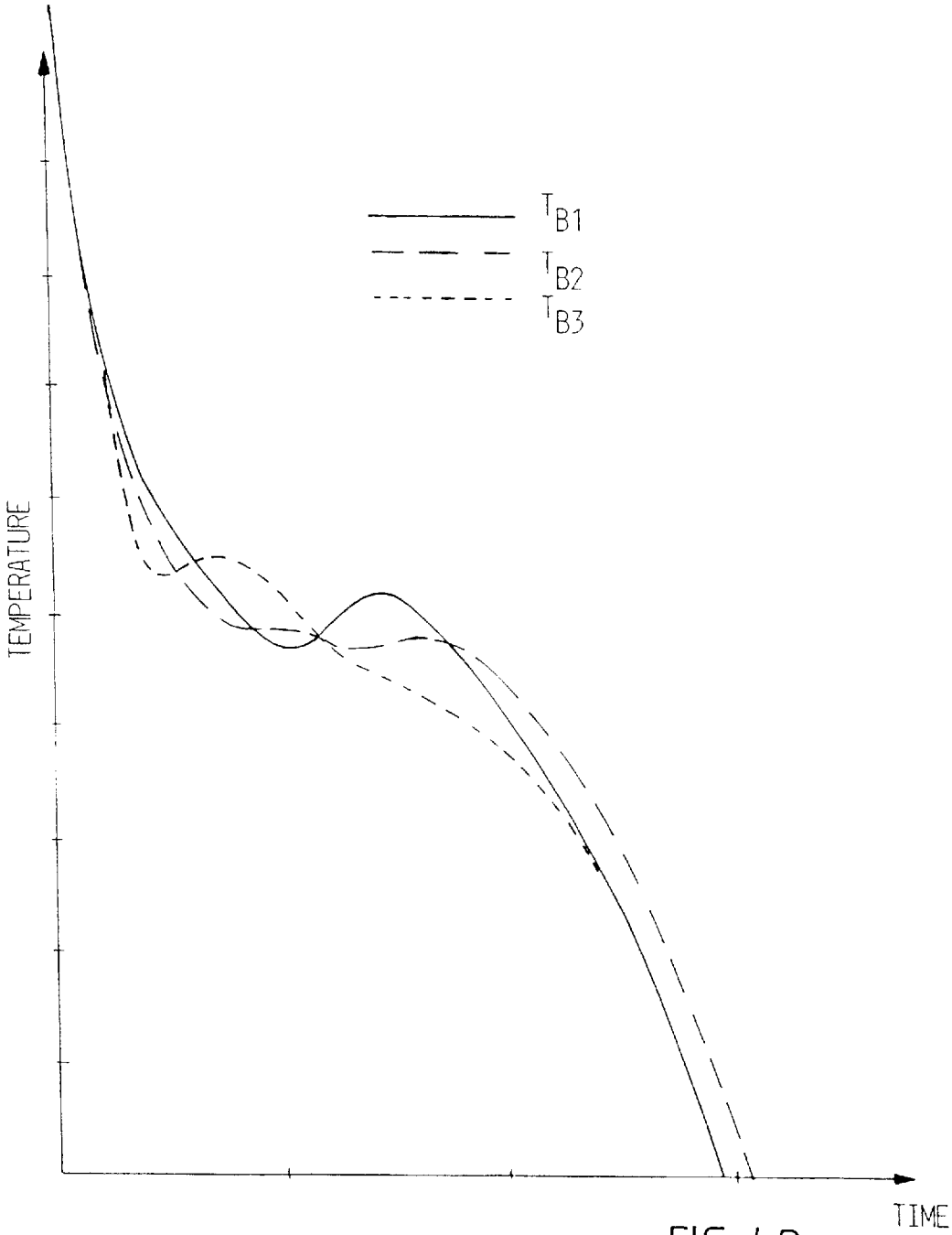
Figure 6:
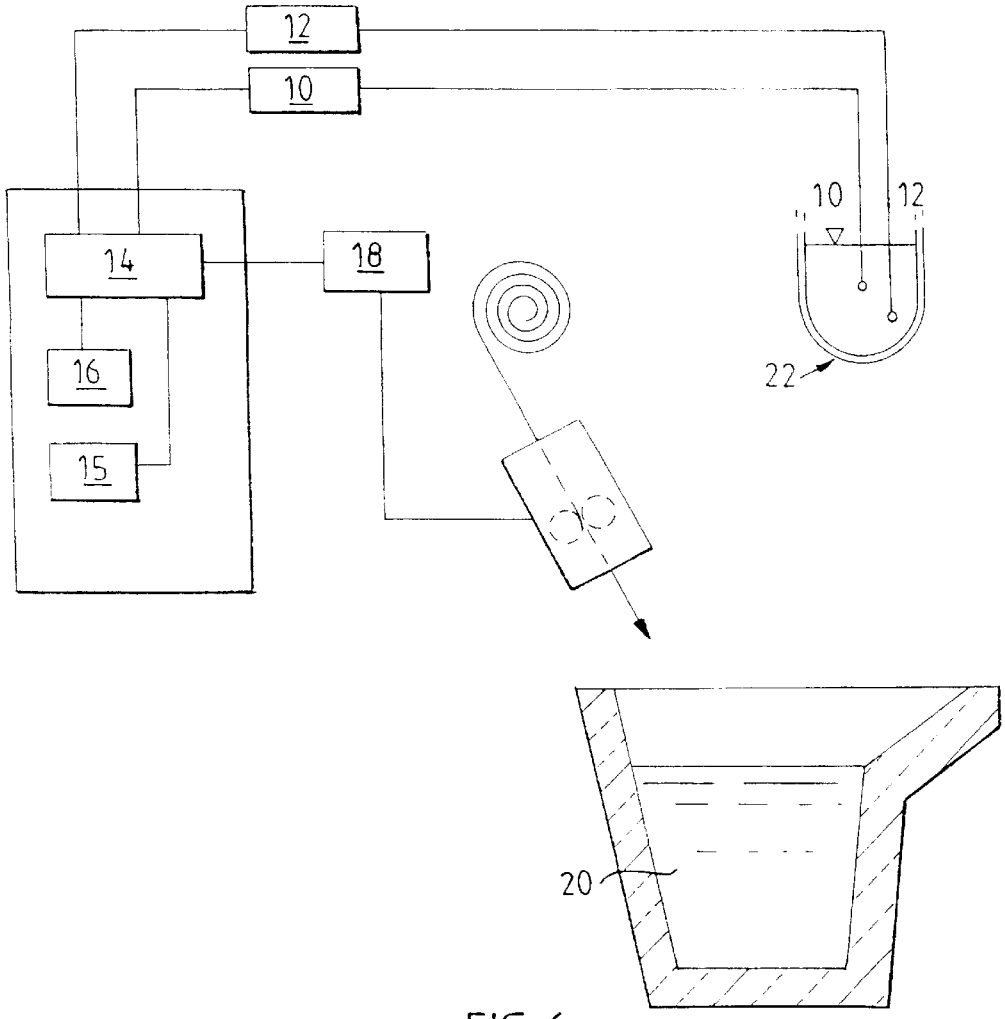

FIG. 4B shows three different appearances of the curve depending on the amount of flake graphite growth during the initial stages of solidification;

FIG. 5 demonstrates currents in a sample of solidifying molten metal and how these currents affect the layer of flake graphite cast iron normally formed in the vicinity of the vessel wall;

FIG. 6 is a schematic presentation of an apparatus for controlling production of compacted graphite cast iron according to the present invention.

As mentioned above, FIG. 1 shows the metal-containing part of a sampling device 200 that can be used when carrying out the present method. Means for filling a sample of molten metal into a sample vessel is not shown. Device 200 is equipped with two sensors, arranged essentially in accordance with the teachings of WO86/01755 cited above. The temperature sensing part 210 of the first temperature responsive sensor 220 is placed in the centre of the molten metal 30, and the temperature-sensing part 230 of the second sensor 240 is arranged at a location close to the interior surface 60 (which may or may not be coated; coating not shown) of the inner wall 50. A sensor support member 250 is provided to hold the sensors 220, 240 in position during analysis. The sensor support member is connected to the container by legs 255, between which molten metal flows into the container when immersed.

FIG. 2 shows an example of a set of cooling curves recorded form two temperature responsive means, one being arranged in the middle of the sample vessel (curve I) and the other near the vessel wall (curve II). Curve I is a typical curve for the compacted graphite solidification in the centre of the sample. The first inflexion point, or thermal arrest, is caused by the formation of primary austenite which is common for hypoeutectic cast irons. In contrast, the inflexion point in curve II indicates the local formation of flake graphite caused by an insufficiency of structure-modifying agent after reaction with the wall coating. Curve II and its corresponding first time derivative is also disclosed in FIG. 3. In this case there is a relationship between the area of the first peak ($\rho_B$) of the first time derivative of the cooling curve and the amount of flake graphite formation in the vicinity of the vessel wall.

When a casting/probe solidifies in a mould/sample vessel, any oxygen, sulphur, etc. in the atmosphere or in the mould/sample vessel material may react with the structure-modifying agents in the cast iron. For compacted graphite cast iron this may result in the formation of flake graphite near the wall of the mould/sample vessel. In fact the amount of flake graphite formed is larger when the concentration of structure-modifying agents is lowered. Hence, the amount of flake graphite formed at the wall can be used as a measure of the concentation of residual structure-modifying agents in the bulk of the metal.

Because flake graphite is nucleated at a higher undercooling temperature than compacted graphite, it can be distinguished by thermal analysis. FIG. 3 shows a cooling curve and corresponding first derivative recorded close to the wall where both flake graphite and compacted graphite are formed. The amount of flake graphite formation can be monitored by measuring the area $\rho_B$ of the first peak of the first derivative of the temperature time curve. The amount of compacted graphite formation can analogously be monitored by measuring the area $\sigma_B$ of the second peak of the first derivative of the temperature time curve.

However, because of the shape of the cooling curve it is sometimes not possible to calculate either or both of the above defined areas ρ and σ. Examples of curves recorded near the wall which are diverging from the ideal curve shape (curve II in FIG. 2 and FIG. 3) are given in FIG. 4B. Until now it has not been possible to evaluate results as represented by curves $T_{B1}$, $T_{B2}$ and $T_{B3}$, and in cases where such curves were obtained the measurement had to be repeated, resulting in productivity losses and possibly rejected iron due to excessive temperature loss.

According to the present invention, an analysis of the cooling curves can be based upon the following fact: As the amount of flake graphite formation increases, the amount of compacted graphite formation must decrease since the total amount of released carbon is approximately constant. FIG. 4A shows a cooling curve recorded near the wall relating to a case where only compacted graphite is formed. The formation of compacted graphite is characterized by the positive maximal slope of the curve ($T'_{Bmax}$) the recalescence ($T_{Bmax}-T_{Bmin}$) and the area $\sigma_B$. FIG. 4B displays the same curve with progressively increasing amounts of flake graphite formation. Both the recalescence, the maximal slope, and the area under the $T'_B$ peak decrease as the amount of flake graphite increases.

The amount of heat liberated by the initial formation of flake graphite in the near-wall region is very small, and indeed insufficient to be relied upon as control parameter. However, if the shape of the bottom of the sample vessel is predominantly spheroidal; and, if the vessel itself is preheated (for example by immersion into the molten iron) thus avoiding formation of a chill zone of solidified iron in the near-wall region; and, if the vessel is allowed to hang freely so that heat is not extracted into a floor or mounting stand, a favourable convection current will develop within the molten iron contained in the sample vessel. These convection currents "rinse" the flake graphite away from the pre-heated upper walls of the sample vessel and effectively concentrate the flake growth in a flow-separated region at the base of the essentially spheroidal vessel. By strategically positioning the wall-sensor within the flow-separated area, one obtains a larger and more sensitive measurement of the flake graphite wall reaction.

The method of the present invention requires four calibrations in order to be carried out, namely:

a) determining the amount of structure-modifying agent that has to be added to the melt in order to obtain compacted graphite cast iron, or spheroidal graphite cast iron, as a function of γ, where $$\gamma=(TA_{max}-TA_{min})/(TB_{max}-TB_{min})$$

and wherein $TA_{max}$ is the local maximum value of the cooling curve recorded at the centre of the sample vessel;

$TA_{min}$ is the local minimum value of the cooling curve recorded at the centre of the sample vessel;

$TB_{max}$ is the local maximum value of the cooling curve recorded at the sample vessel wall;

$TB_{min}$ is the local minimum value of the cooling curve recorded at the sample vessel wall;

b) determining the amount of structure-modifying agent that has to be added to the melt in order to obtain compacted graphite cast iron, or spheroidal graphite cast iron, as a function of ϕ, where $$\phi=(TA'_{max})/(TB'_{max})$$

wherein $TA'_{max}$ is the maximum value of the first derivative of the cooling curve recorded at the centre of the sample vessel; and $TB'_{max}$ is the maximum value of the first derivative of the cooling curve recorded at the sample vessel wall;

c) determining the amount of structure-modifying agent that has to be added to the melt in order to obtain compacted graphite cast iron as a function of the area ($\rho_B$) of the first peak of the first derivative of the cooling curve recorded at the sample vessel wall;

d) determining the amount of structure-modifying agent that has to be added to the melt in order to obtain compacted graphite cast iron, or spheroidal cast iron as a function of κ, where:

$$\kappa=\sigma_A/\sigma_B$$

wherein $\sigma_A$ is the area under the second peak of the first derivative of the cooling curve recorded in the centre of the sample vessel; and $\sigma_B$ is the area under the second peak of the first derivative of the cooling curve recorded at the vessel wall;

Naturally, corresponding calibrations are carried out when producing spheroidal graphite cast iron.

Most of the calibrations are based on cooling curves recorded in the centre of the sample vessel. The reason for this is that normally there is no flake formation in the centre and hence, $TA_{max}-TA_{min}$, $TA'_{max}$ and $\sigma_A$ are not negatively affected by flake graphite precipitation. The centre can accordingly be used as a reference point even when modification is so low that flake graphite is formed at the wall.

The amount of structure-modifying agent that has to be added to a particular sample is calculated after carrying out a conventional thermal analysis as described in the previously cited documents WO86/01755 and WO92/06809. The cooling curves are then analysed determining γ, ϕ, $\rho_B$ and κ. Three independent determinations of the amount of structure-modifying agents that has to be added are carried out, and it is then simple for the skilled person to choose the determination giving the most accurate result.

It is preferred to carry out the prediction method by using a computer-controlled system, especially when a large number of measurements must be carried out. In this case the same kind of sampling device 22 that has been described above is used. Such a computer-controlled system is outlined in FIG. 6. During the measurement of a particular sample the two temperature responsive means 10, 12 send signals to a computer 14 comprising a ROM unit 16 and a RAM unit 15 in order to generate the cooling curves. The computer has access to the above mentioned calibration data in a ROM unit 16 and calculates the amount of structure-modifying agents that must be added to the melt. This amount is signalled to a means 18 for administrating structure-modifying agent to the melt 20 to be corrected, whereby the melt is supplied with an appropriate amount of such agents.

What is claimed is:

1. A process for producing a compacted graphite iron casting, or spheroidal graphite cast iron, requiring a sampling device, means for monitoring temperature as a function of time and a means for administrating structure-modifying agents to a molten cast iron from which said casting is to be produced, said method comprising the steps of:

a) for the chosen casting method carrying out the following calibrations:

i) determining the amount of structure-modifying agent that has to be added to the melt in order to obtain compacted graphite cast iron, or spheroidal graphite cast iron, as a function of a first control coefficient γ, where $$\kappa=(TA_{max}-TA_{min})/(TB_{max}-TB_{min})$$

and wherein $TA_{max}$ is the local maximum value of the cooling curve recorded at the centre of the sample vessel during solidification of a cast iron sample;

$TA_{min}$ is the local minimum value of the cooling curve recorded at the centre of the sample vessel during solidification of a cast iron sample;

$TB_{max}$ is the local maximum value of the cooling curve recorded at the sample vessel wall during solidification of a cast iron sample;

$TB_{min}$ is the local minimum value of the cooling curve recorded at the sample vessel wall during 'solidification of a cast iron sample;

ii) determining the amount of structure-modifying agent that has to be added to the melt in order to obtain compacted graphite cast iron, or spheroidal graphite cast iron, as a function of a second control coefficient ϕ, where $$\phi=(TA'_{max})/(TB'_{max})$$

wherein $TA'_{max}$ is the maximum value of the first derivative of the cooling curve recorded at the centre of the sample vessel during solidification of a cast iron sample; and $TB'_{max}$ is the maximum value of the first derivative of the cooling curve recorded at the sample vessel wall during solidification of a cast iron sample;

iii) determining the amount of structure-modifying agent that has to be added to a molten cast iron in order to obtain compacted graphite cast iron, or spheroidal graphite cast iron, as a function of a third control coefficient ($\sigma_B$), which is the area under the first peak of the first derivative of a cooling curve recorded at the sample vessel wall during solidification of a cast iron sample;

iv) determining the amount of structure-modifying agent that has to be added to the melt in order to obtain compacted graphite cast iron, or spheroidal cast iron as a function of a fourth control coefficient κ, where:

$$\kappa=\sigma_A/\sigma_B$$

wherein $\sigma_A$ is the area under the second peak of the first derivative of the cooling curve recorded in the centre of the sample vessel; and $\sigma_B$ is the area under the second peak of the first derivative of the cooling curve recorded at the vessel wall;

b) during solidification recording cooling curves at the centre of a sample vessel and at the sample vessel wall, respectively, for a particular sample of a molten cast iron;

c) calculating control coefficients γ, ϕ, $\rho_B$ and κ relating to the temperature time curves obtained in step b) and choosing one of these coefficients γ, ϕ, $\rho_B$ and κ giving the most accurate result;

d) calculating the amount of stucture modifying agent (Va) that has to be added to the melt;

e) add the calculated amount of structure modifying agent; and f) carry out the casting operation in a per se known manner.

2. A process according to claim 1, characterized in that an essentially spheroidal sample vessel is used, and in that cooling curves recorded near the vessel wall are recorded in a flow-separated area at the base of said essentially spheroidal sample vessel.

3. A process according to claim 1 or claim 2, characterized in that compacted graphite cast iron is produced.

4. A method for determining the amount of structure modifying agent that has to be added to molten cast iron in order to produce a compacted graphite iron casting, or spheroidal graphite cast iron, which method requires a sampling device, means for monitoring temperature as a function of time and a means for administating structure-modifying agents to a molten cast iron from which said casting is to be produced, said method comprising the steps of:

a) for the chosen casting method carrying out the following calibrations:

i) determining the amount of structure-modifying agent that has to be added to the melt in order to obtain compacted graphite cast iron, or spheroidal graphite cast iron, as a function of a first control coefficient γ, where $$\gamma=(TA_{max}-TA_{min})/(TB_{max}-TB_{min})$$

and wherein $TA_{max}$ is the local maximum value of the cooling curve recorded at the centre of the sample vessel during solidification of a cast iron sample;

$TA_{min}$ is the local minimum value of the cooling curve recorded at the centre of the sample vessel during solidification of a cast iron sample;

$TB_{max}$ is the local maximum value of the cooling curve recorded at the sample vessel wall during solidification of a cast iron sample;

$TB_{min}$ is the local minimum value of the cooling curve recorded at the sample vessel wall during solidification of a cast iron sample;

ii) determining the amount of structure-modifying agent that has to be added to the melt in order to obtain compacted graphite cast iron, or spheroidal graphite cast iron, as a function of a second control coefficient ϕ, where $$\phi=(TA'_{max})/(TB'_{max})$$

wherein $TA'_{max}$ is the maximum value of the first derivative of the cooling curve recorded at the centre of the sample vessel during solidification of a cast iron sample; and $TB'_{max}$ is the maximum value of the first derivative of the cooling curve recorded at the sample vessel wall during solidification of a cast iron sample;

iii) determining the amount of structure-modifying agent that has to be added to a molten cast iron in order to obtain compacted graphite cast iron, or spheroidal graphite cast iron, as a function of a third control coefficient ($\rho_B$), which is the area under the first peak of the first derivative of a cooling curve recorded at the sample vessel wall during solidification of a cast iron sample;

d) determining the amount of structure-modifying agent that has to be added to the melt in order to obtain compacted graphite cast iron, or spheroidal cast iron as a function of κ, where:

$$\kappa=\sigma_A/\sigma_B$$

wherein $\sigma_A$ is the area under the second peak of the first derivative of the cooling curve recorded in the centre of the sample vessel; and $\sigma_B$ is the area under the second peak of the first derivative of the cooling curve recorded at the vessel wall;

b) during solidification recording cooling curves at the centre of a sample vessel and at the sample vessel wall, respectively, for a particular sample of a molten cast iron;

c) calculating control coefficients γ, ϕ, $\rho_B$ and κ relating to the temperature time curves obtained in step b) and choosing one of these coefficients γ, ϕ, ρ and κ giving the most accurate result;

d) calculating the amount of stuctural modifying agent (Va) that has to be added to the melt.

5. A process according to claim 4, characterized in that an essentially spheroidal sample vessel is used, and in that cooling curves recorded near the vessel wall are recorded in a flow-separated area at the base of said essentially spheroidal sample vessel.

6. A method according to claim 4 or claim 5, characterized in that a compacted graphite iron casting is produced.

7. An apparatus for establishing, in real time, an amount of a structure modifying agent to be added to a cast iron melt (20) during the process of producing a compacted graphite iron casting;

the apparatus comprising:

a first temperature sensor (10) for recording a cooling curve at the centre of a sample vessel;

a second temperature sensor (12) for recording a cooling curve in the vicinity of the sample vessel wall;

a computer device (14) for determining an amount value (Va) of a structure modifying agent to be added to the melt, a memory means (16) which is provided with prerecorded cooling curve data, the computer device being set up to establish a first control coefficient, γ, (from which a first prediction value (V1) can be calculated,) where $$\gamma=(TA_{max}-TA_{min})/(TB_{max}-TB_{min})$$

and wherein $TA_{max}$ is the local maximum value of the cooling curve recorded at the centre of the sample vessel during solidification of a cast iron sample;

$TA_{min}$ is the local minimum value of the cooling curve recorded at the centre of the sample vessel during solidification of a cast iron sample;

$TB_{max}$ is the local maximum value of the cooling curve recorded at the sample vessel wall during solidification of a cast iron sample;

$TB_{min}$ is the local minimum value of the cooling curve recorded at the sample vessel wall during solidification of a cast iron sample;

the computer device being set up to establish a second control coefficient ϕ, (from which a second prediction value (V2) can be calculated,) where $$\phi=(TA'_{max})/(TB'_{max})$$

wherein $TA'_{max}$ is the maximum value of the first derivative of the cooling curve recorded at the centre of the sample vessel during solidification of a cast iron sample; and $TB'_{max}$ is the maximum value of the first derivative of the cooling curve recorded at the sample vessel wall during solidification of a cast iron sample;

the computer device being set up to attemt to establish a third control coefficient ($\rho_B$), (from which a third prediction value (V3) can be calculated,) where the third control coefficient ($\rho_B$) relates to the area of the first peak of the first derivative of the cooling curve recorded at the sample vessel wall;

the computer device being set up to attemt to establish a fourth control coefficient (κ), (from which a fourth prediction value (V4) can be calculated), where $$\kappa=\sigma_A/\sigma_B$$

and wherein $\sigma_A$ is the area under the second peak of the first derivative of the cooling curve recorded in the centre of the sample vessel; and $\sigma_B$ is the area under the second peak of the first derivative of the cooling curve recorded at the vessel wall;

the computer device being set up to compare the first, second, third and fourth control coefficients (γ, ϕ, $\sigma_B$ and κ) with the prerecorded cooling curve data, and the computer device being set up to choose one of the control coefficients (γ, ϕ, $\sigma_B$ and κ) in response to the result of the comparison, and wherein the computer device is set up to calculate a precise amount value (Va) of a structure modifying agent to be added to the melt in response to the choosen control coefficient (γ, ϕ, $\rho_B$ and κ).

8. An apparatus according to claim 7, characterized in that the second temperature sensor (12) is arranged in such a way that the cooling curves recorded near the wall of the sample vessel wall are recorded in a flow-separated area at the base of an essentially spheroidal sample vessel.

9. An apparatus for establishing, in real time, an amount of a structure modifying agent to be added to a cast iron melt (20) during the process of producing a speroidal graphite iron casting;

the apparatus comprising a first temperature sensor (10) for recording a cooling curve at the centre of a sample vessel;

a second temperature sensor (12) for recording a cooling curve in the vicinity of the sample vessel wall;

a computer device (14) for determining an amount value (Va) of a structure modifying agent to be added to the melt, a memory means (16) which is provided with prerecorded cooling curve data, the computer device being set up to establish a first control coefficient, γ, (from which a first prediction value (V1) can be calculated,) where $$\gamma=(TA_{max}-TA_{min})/(TB_{max}-TB_{min})$$

and wherein $TA_{max}$ is the local maximum value of the cooling curve recorded at the centre of the sample vessel during solidification of a cast iron sample;

$TA_{min}$ is the local minimum value of the cooling curve recorded at the centre of the sample vessel during solidification of a cast iron sample;

$TB_{max}$ is the local maximum value of the cooling curve recorded at the sample vessel wall during solidification of a cast iron sample;

$TB_{min}$ is the local minimum value of the cooling curve recorded at the sample vessel wall during solidification of a cast iron sample;

the computer device being set up to establish a second control coefficient $\phi$, (from which a second prediction value (V2) can be calculated,) where $$\phi=(TA'_{max})/(TB'_{max})$$

wherein $TA'_{max}$ is the maximum value of the first derivative of the cooling curve recorded at the centre of the sample vessel during solidification of a cast iron sample; and $TB'_{max}$ is the maximum value of the first derivative of the cooling curve recorded at the sample vessel wall during solidification of a cast iron sample;

the computer device being set up to attemt to establish a third control coefficient ($\rho_A$), (from which a third prediction value (V3) can be calculated,) where the third control coefficient ($\rho_B$) relates to the area of the first peak of the first derivative of the cooling curve recorded at the sample vessel wall;

the computer device being set up to attemt to establish a fourth control coefficient ($\kappa$), (from which a fourth prediction value (V4) can be calculated), where $$\kappa=\sigma_A/\sigma_B$$

and wherein $\sigma_A$ is the area under the second peak of the first derivative of the cooling curve recorded in the centre of the sample vessel; and $\sigma_B$ is the area under the second peak of the first derivative of the cooling curve recorded at the vessel wall;

the computer device being set up to compare the first, second, third and fourth control coefficients ($\gamma$, $\phi$, $\rho_B$ and $\kappa$) with the prerecorded cooling curve data, and the computer device being set up to choose one of the control coefficients ($\gamma$, $\phi$, $\rho_B$ and $\kappa$) in response to the result of the comparison, and wherein the computer device is set up to calculate a precise amount value (Va) of a structure modifying agent to be added to the melt in response to the choosen control coefficient ($\gamma$, $\phi$, $\rho_B$ and $\kappa$).

10. An apparatus according to claim 9, characterized in that the second temperature sensor (12) is arranged in such a way that the cooling curves recorded near the wall of the sample vessel wall are recorded in a flow-separated area at the base of an essentially spheroidal sample vessel.

11. An apparatus for carrying out the process of claims 1 or 2, the apparatus comprising:

a sampling device (22) for taking a sample of molten cast iron from a cast iron melt (20) from which a casting comprising CGI or SGI is to be produced;

a first temperature sensor (10) for recording a cooling curve at the centre of a sample vessel;

a second temperature sensor (12) for recording a cooling curve in the vicinity of the sample vessel wall;

a computer device (14) for determining an amount value (Va) of a structure modifying agent to be added to the melt, a memory means (16) which is provided with prerecorded cooling curve data, a means (18) for administrating a correct amount of a structure-modifying agent in response to a signal from the computer device, said signal corresponding to said amount value (Va)

the computer device being set up to establish a first control coefficient, $\kappa$, (from which a first prediction value (V1) can be calculated,) where $$\gamma=(TA_{max}-TA_{min})/(TB_{max}-TB_{min})$$

and wherein $TA_{max}$ is the local maximum value of the cooling curve recorded at the centre of the sample vessel during solidification of a cast iron sample;

$TA_{min}$ is the local minimum value of the cooling curve recorded at the centre of the sample vessel during solidification of a cast iron sample;

$TB_{max}$ is the local maximum value of the cooling curve recorded at the sample vessel wall during solidification of a cast iron sample;

$TB_{min}$ is the local minimum value of the cooling curve recorded at the sample vessel wall during solidification of a cast iron sample;

the computer device being set up to establish a second control coefficient $\phi$, (from which a second prediction value (V2) can be calculated,) where $$\phi=(TA'_{max})/(TB'_{max})$$

wherein $TA'_{max}$ is the maximum value of the first derivative of the cooling curve recorded at the centre of the sample vessel during solidification of a cast iron sample; and $TB'_{max}$ is the maximum value of the first derivative of the cooling curve recorded at the sample vessel wall during solidification of a cast iron sample;

the computer device being set up to attemt to establish a third control coefficient ($\rho_A$), (from which a third prediction value (V3) can be calculated,) where the third control coefficient ($\rho_B$) relates to the area of the first peak of the first derivative of the cooling curve recorded at the sample vessel wall;

the computer device being set up to attemt to establish a fourth control coefficient ($\kappa$), (from which a fourth prediction value (V4) can be calculated), where $$\kappa=\sigma_A/\sigma_B$$

and wherein $\sigma_A$ is the area under the second peak of the first derivative of the cooling curve recorded in the centre of the sample vessel; and $\sigma_B$ is the area under the second peak of the first derivative of the cooling curve recorded at the vessel wall;

the computer device being set up to compare the first, second, third and fourth control coefficients ($\gamma$, $\phi$, $\rho_B$ and $\kappa$) with the prerecorded cooling curve data, and the computer device being set up to choose one of the control coefficients ($\gamma$, $\phi$, $\rho_B$ and $\kappa$) in response to the result of the comparison, and wherein the computer device is set up to calculate a precise amount value (Va) of a structure modifying agent to be added to the melt in response to the choosen control coefficient ($\gamma$, $\phi$, $\rho_B$ and $\kappa$).

the computer being set up to send a signal corresponding to said amount value to said means (18), whereby a correct amount of structure-modifying agent is added to the melt (20).

12. An apparatus according to claim 11, characterized in that the second temperature sensor (12) is arranged in such a way that the cooling curves recorded near the wall of the sample vessel wall are recorded in a flow-separated area at the base of an essentially spheroidal sample vessel.

* * * * *